United States Patent [19]

Staszko

[11] Patent Number: 4,709,627

[45] Date of Patent: Dec. 1, 1987

[54] LOCKING SLEEVE MAGAZINE FEED ATTACHMENT FOR A DEVICE FOR SEALING STEEL WRAPPING BANDS

[75] Inventor: Wladyslaw Staszko, Duisburg, Fed. Rep. of Germany

[73] Assignee: ACME P.W. Lenzen GbmH & Co. KG, Fed. Rep. of Germany

[21] Appl. No.: 892,140

[22] Filed: Jul. 30, 1986

[30] Foreign Application Priority Data

Aug. 2, 1985 [DE] Fed. Rep. of Germany ..... 3527695

[51] Int. Cl.[4] ..... B65B 13/34

[52] U.S. Cl. ..... 100/30; 53/582; 100/33 R; 221/198; 140/93.2

[58] Field of Search ..... 53/138 A, 138 R, 582, 53/139.3, 588, 391; 100/30, 33 R; 221/58, 59, 60, 72, 73, 188, 198; 140/93.2, 93.4

[56] References Cited

U.S. PATENT DOCUMENTS

| | | | |
|---|---|---|---|
| 1,576,637 | 3/1926 | Egelin | 221/188 |
| 3,545,499 | 12/1970 | Dalton | 100/33 R |
| 3,768,397 | 10/1973 | Plattner | 100/30 |
| 3,804,001 | 4/1974 | Longerich et al. | 100/33 R |
| 4,428,176 | 1/1984 | Burrell | 53/138 A |

FOREIGN PATENT DOCUMENTS

| | | | |
|---|---|---|---|
| 589295 | 12/1959 | Canada | 221/189 |
| 1511916 | 5/4966 | Fed. Rep. of Germany . | |
| 405212 | 2/1934 | United Kingdom | 221/189 |

*Primary Examiner*—Robert L. Spruill
*Assistant Examiner*—Donald R. Studebaker
*Attorney, Agent, or Firm*—Jacobs & Jacobs

[57] ABSTRACT

There is described a tube magazine on a device for sealing steel wrapping bands around filled packages in which to seal the steel wrapping bands the steel band is initially conveyed twice through a first smooth oval sheet metal tube contained in the tube magazine wih corresponding steel band lead-in openings provided in the tube magazine. To improve its functioning, the tube magazine is carried on a stationary axle that is parallel to the direction of conveyance of the steel band, which housing can swivel in limited manner such that in the first end position the first tube stored in the tube magazine is disposed coaxially opposite and in correct position to the steel band to be conveyed, while in the other end position the tube magazine is outside the steel band which is guided sideways, and in the outside of the tube magzine, which is turned toward the second magzine end position and runs parallel to the direction of conveyance of the steel band, there is a recess that is at least the size of a tube. On the tube magazine there is a rigid tube stop that positions the first tube in correct position in front of the said recess.

9 Claims, 3 Drawing Figures

Figure 1:
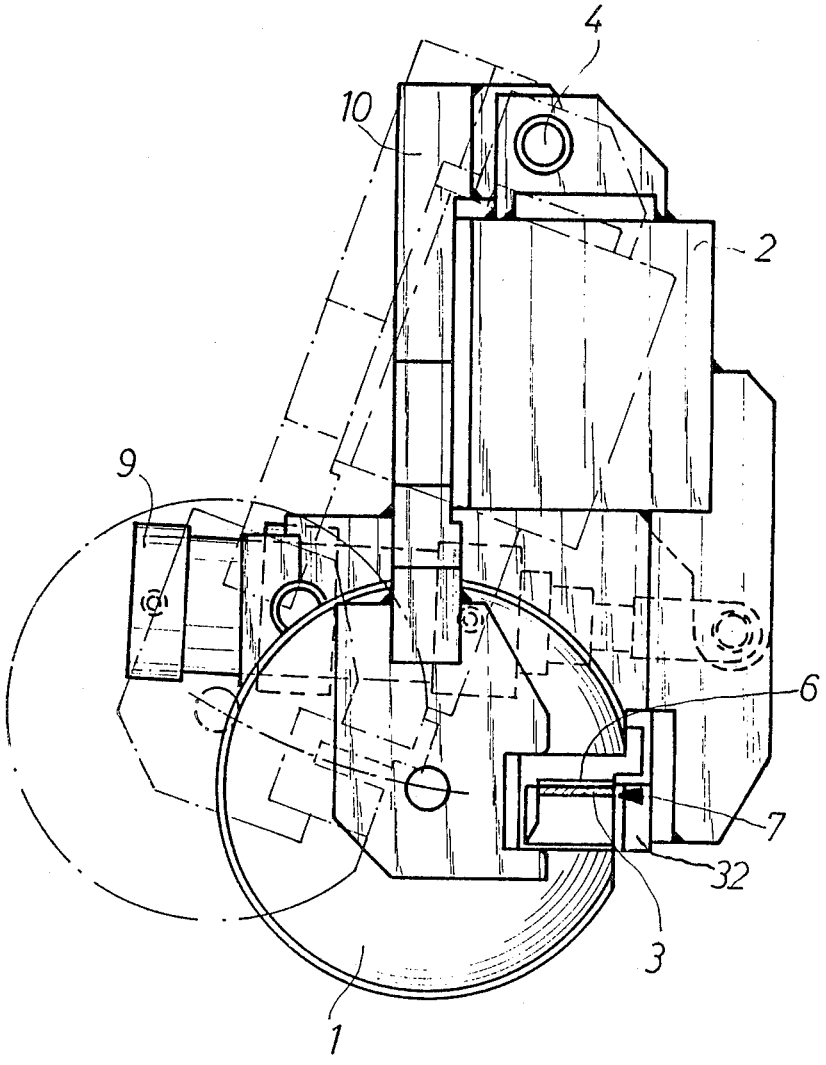

29
1
14
15
19
16
27
28
21
18
17
20

LOCKING SLEEVE MAGAZINE FEED ATTACHMENT FOR A DEVICE FOR SEALING STEEL WRAPPING BANDS

The present invention relates to a sleeve magazine feed attachment on a device for mechanically sealing a steel wrapping band for filled packages with the aid of sheet metal tubes positioned one behind the other in the magazine feed attachment and comprising a conveyor for removing the steel wrapping band from a storage bin and conducting it to and placing it on a filled package, a sealing device to notch the steel band edges encompassed by the sheet metal tube, a sleeve magazine feed attachment and a stop device acting on the advancing steel band ends which are positioned one behind the other, and in which, in order to seal the steel wrapping band, the steel band is first run twice through a first smooth, oval sheet metal tube stored in the sleeve magazine feed attachment for which purpose there are provided suitable steel band pass-through openings.

A device of this general type is known from DE-AS No. 15 11 916.

In the present invention there is a straight, rod-shaped magazine feed attachment in upright position the end section of which faces the steel band and which feed attachment has a steel band pass-through opening on each side, oppositely facing each other.

Furthermore, the present sleeve magazine feed attachment is open at the aforementioned end and has spring-type catch hooks which fit into the sleeve guide channel of the magazine and which catch hooks prevent the sheet metal tubes from being pushed out through the side opening of the magazine.

Moreover, after the steel band has been guided through, the first sheet metal tube which has been maintained in readiness in the magazine is pulled out of the magazine through one of the tightening strap guide openings from the bent steel band end that wraps around the sheet metal tube by means of the tightening movement of the steel wrapping band, that is, lengthwise along the steel band, and it is then drawn into the sleeve locking mechanism.

The high motor pulling forces heretofore necessary in this type of device for this operation create the danger that as a result of incorrect positioning relative to the tightening strap lead-out openings, the sheet metal tube gripped by the tigtening strap will become jammed in the sleeve magazine and will have to be pulled out manually.

This danger is particularly great when sheet metal tubes curved out of sheet metal strips are used, the ends of which overlap one another in such manner that one metal strip end is positioned at an acute angle to the opposite, straight part of the smooth oval sheet metal tube, because then the tubes located in the magazine and following and resting against one another are already being fed in incorrect alignment and hence the steel band cannot be fed into the tube.

The main purpose of this invention is to improve on a sheet metal tube magazine of the known type described above by simple means and measures in such manner that a more or less non-disruptable feed of the sleeves in the magazine can be achieved as well as a considerably simpler and surer conveyance out of the magazine of the tubes gripped by a tightening band.

The implementation of this purpose is characterized by the fact that the tube magazine is carried on a stationary axle parallel to the feed direction of the steel tube and able to swivel horizontally, to a limited extent, in such manner that in the first end position the first tube in the tube magazine faces, coaxially and in correct position, the steel band to be fed through, while in the other end position the tube magazine is located outside the steel band which is guided sideways. In the outside of the tube magazine, which faces the second magazine end position and parallels the direction of conveyance of the steel band, there is at least one recess the size of the tube and in the tube magazine there is a tube buttress or abutment that positions the first tube in correct position in front of said recess, the tube magazine also preferably having a motor swivel drive in the form of a working cylinder.

To release a tube gripped by the tightening band, the tube magazine swivels away from the tightening band, crosswise to the lengthwise direction of the tightening band, which is fed sideways. If necessary, the curvature of the tube runs along the edges of the recess, thereby ensuring the keeping of the tube in correct position relative to the recess without any manual intervention.

In addition, the catch hooks heretofore required, which had a spring action and consequently were susceptible to problems, are eliminated. When tubes made of sheet metal strips are bent into a smooth, oval ring shape with the strip ends overlapping, the first strip end portion runs parallel to the straight tube area lying opposite, while the second ring end outside and resting on the first ring end is positioned at an acute angle to the aforesaid sleeve area. For the obtaining of a proper positioning of the tubes relative to the recess, it is particularly advantageous if the tubes in the tube magazine are positioned in the conveyance direction of the tubes with their overlapping ends forward, and also if the first strip end portion is positioned adjoining the magazine recess and also if the tube buttress has an obtuse-angled tube positioning surface, and further if, moreover, the first portion of the positioning surface in the first end position of the tube magazine runs parallel to the long cross-section side of the steel band, the second part of the positioning surface, constructed for the positioning of the second strip end portion, is arranged at such an obtuse angle as to represent the supplementary or continuous angle to the angle that enclosed the second strip end portion whereby the straight area of the tube faces the said second strip end portion.

In a preferred embodiment of the objective of this invention, the tube magazine is constructed as a drum magazine, and the tubes in the magazine are positioned with their long cross-section center axes arranged radially, and preferably the tubes in the drum magazine are each directed radially with respect to the second strip end portion.

Through these novel means all the tubes in the magazine are positioned in such relationship to one another that they are conveyed forward in correct position with respect to the recess. This creates the further advantage that the tube magazine can be packed with more tubes than previously known tube magazines.

Other advantageous characteristics of the invention include the benefits of improving the manufacture and handling of the tube magazine when it is filled with tubes, and also the functioning of the tube magazine as disclosed hereinafter.

Figure 2:
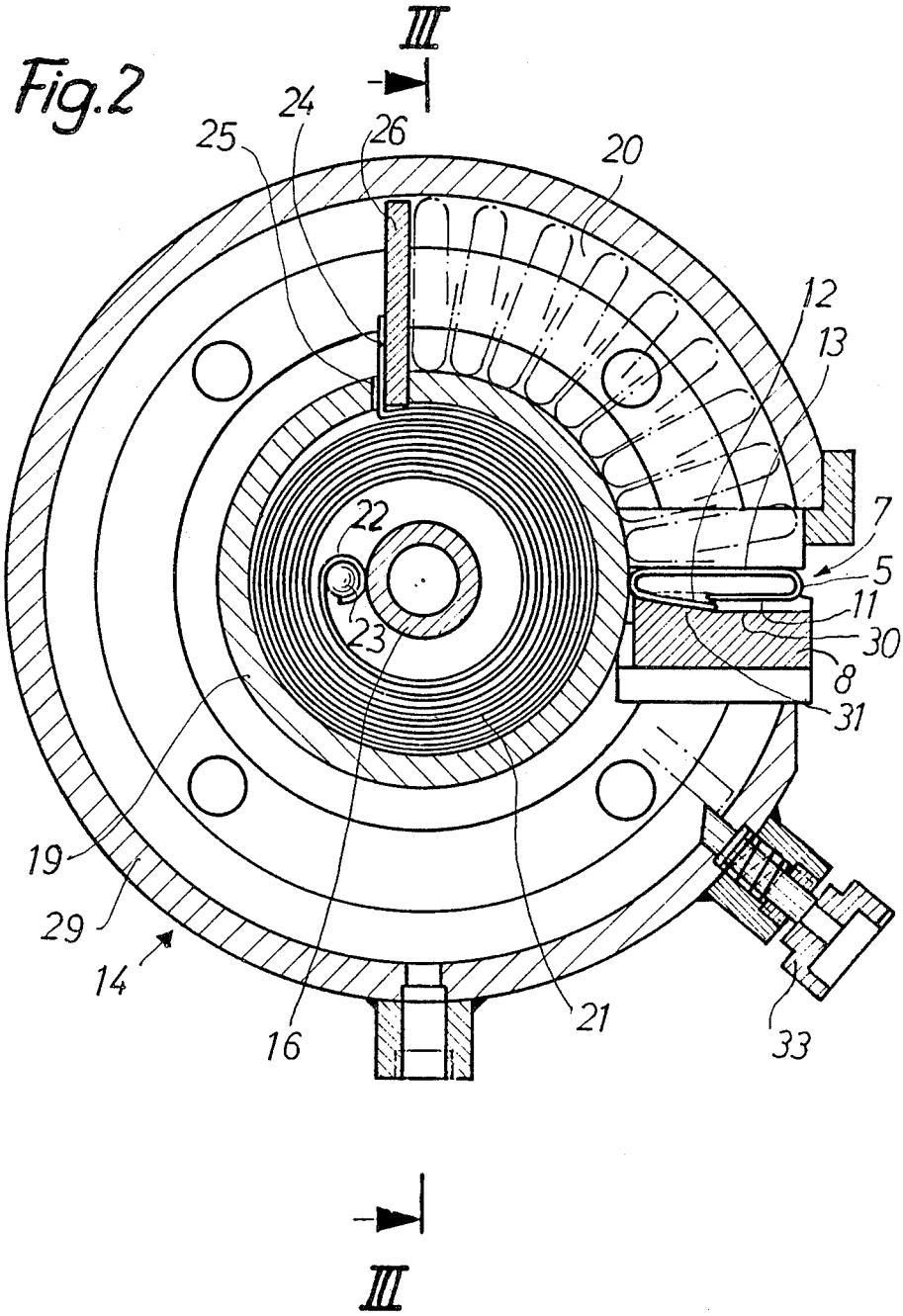
Figure 3:
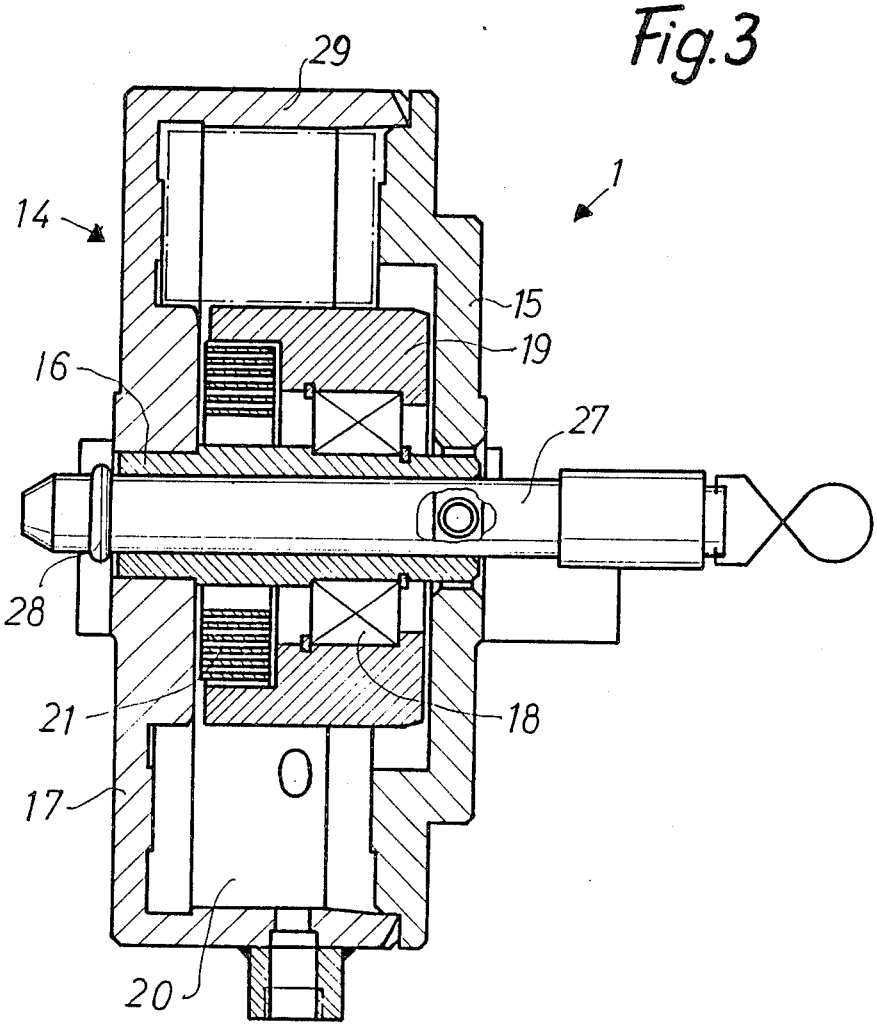

A detailed embodiment of the invention is described below and shown in the drawings in which:

FIG. 1 is a frontal view of a device according to the invention for sealing a tube magazine integrated with a steel wrapping band, FIG. 2 is a cross-sectional view of the same device as in FIG. 1 drawn to a larger scale, and FIG. 3 is a sectional view of the same device taken on line III—III of FIG. 2.

The tube magazine 1, constructed as a drum magazine, is carried on the stationary portions 2 of a device, only a portion of which is shown, for sealing steel wrapping bands around an axle 4 running parallel to the feed direction of steel band 3, and can be pivoted to a limited extent in such manner that in the first end position of the tube magazine the first tube 5 in the tube magazine faces the moving steel band 3 in correct position and coaxially. In the other, second end position of tube magazine 1, as indicated by the dash lines, the tube magazine 1 is outside steel band 3, which fits through stationary straight guides in known manner and is thus not illustrated.

Each front end of tube magazine 1 has a steel band lead-out opening 6, aligned radially, and aligned with steel band 3. In the casing of the tube magazine 1 there is a recess 7 which is at least the size of a tube and is positioned on the same level as the steel band lead-out opening 6, in such manner that the tube 5 is maintained in readiness in tube magazine 1 and withdrawn by the steel band 3 for release from the tube magazine 1 for sealing by the swivelling of tube magazine 1 into the second end position.

In tube magazine 1 a rigid tube buttress 8 is attached to position each first tube 5 precisely before recess 7 in correct position.

A working cylinder 9 is provided for the automatic swivelling of the tube magazine. The connecting rod of said working cylinder 9 is coupled to frame 2, and its cylinder engages with a pivot arm 10, to which tube magazine 1 is attached.

The tube magazine constructed as a drum magazine is designed to hold sheet metal tubes 5 that consists of a strip bent into a smooth oval ring, the strip end portions 11 and 12 overlapping in such manner that the first strip end portion 11 extends parallel to the straight tube area 13 lying opposite, while the other, second end portion 12 resting on first strip end portion 11 is positioned at an acute angle to the aforesaid straight tube area 13.

The tubes 5 are positioned in the tube magazine in the direction of conveyance of the tubes, with their overlapping strip end portions 11 and 12 facing forward.

Moreover, the first strip end portion 11 is adjacent to recess 7.

Furthermore, tubes 5 are arranged in tube magazine 1 with their long cross-section center axis positioned radially, with end portion 12 resting for support on the outside of the straight tube area 13 of the adjacent tube.

The tube magazine 1 is constructed as a chamber-like cylindrical housing 14 with a cover 15 that is connected to and can be removed from the nozzle of said housing.

An axially arranged axle 16 that is attached to housing floor 17 passes through housing 14 and cover 15. Cover 15 is removably attached to axle 16. A cylindrical tube 19 is rotatable on axle 16 due to roller bearing 18. Cylindrical tube 19 together with housing 14 and cover 15 form a circular tube guide channel 20.

A pre-stressed spiral spring 21 is inserted into tube 19. The inner end portion 22 of said pre-stressed spiral spring 21 is attached to housing 14 by means of a peg 23. The outer, bent end portion 24 of spiral spring 21 passes through a radially positioned slit 25 in tube 19. A sleeve valve 26 is attached to the end portion 24 that fits into the tube guide channel 20.

Axle 16 has an axial hole through which passes a removable pin 27 that holds cover 15 to housing 14 in alignment. This plug-type connection is secured by means of a snap ring 28, which is inserted into a snap ring groove of pin 27 and which is supported in alignment with housing floor 17.

Snap ring 28 can be removably inserted into the snap ring groove provided for it.

However, it is possible to make the snap ring groove so deep that snap ring 28 can temporarily go into the snap ring groove when it is desired to loosen the pin through high axial loading of the snap ring 28.

The steel band lead-out openings 6 are positioned in housing floor 17 or in cover 15. Housing sleeve 29 is provided with a recess 7. Tube buttress 8 is attached to housing 14. It has an obtuse-angled positioning surface for the tube 5 held in readiness in magazine 1. The first portion 30 of the positioning surface of tube buttress 8 is positioned parallel to the long cross-section side of the steel band. The other, second portion 31 of the positioning surface is designed for the positioning of the second strip end portion 12 of a tube 5 and is positioned at an obtuse angle (e.g. 170°) that includes the second strip end portion 12 and tube area 13.

Frame 2 has a buffer 32 which terminates the first swivel end position of tube magazine 1. Also, tube magazine 1 has a stop 33 that separably grips sleeve valve 26 in its rear end position, to facilitate the inserting of tubes 5 into tube guide channel 26.

What is claimed is:

1. A locking sleeve magazine feed attachment on a device for mechanically sealing a steel wrapping band on filled packages having sheet metal tubes stored in the locking sleeve magazine, comprising conveyor means for removing the steel band from an associated storage bin and conveying it to and placing it around and tightening it on the filled package, a sealing device for notching the steel band edges surrounded by the sheet metal tube, a locking sleeve storage holder, a stop device acting on the advancing steel band ends which are positioned one behind the other, means for sealing the steel wrapping band which is first run twice through a first smooth, oval sheet metal tube stored in the sleeve magazine storage holder, steel band pass-through openings being provided for such purpose, the tube magazine being mounted on a stationary axle arranged in parallel to the feed direction of the steel band and arranged to swivel horizontally to a limited extent, whereby in the first swivel position the first tube faces coaxially and in correct position with respect to the steel band to be fed through, and in the other swivel position the tube magazine is located externally of the steel band which is guided sideways on the outside of the tube magazine which faces the second magazine swivel position in the direction of tube movement and extends parallel to the feed direction of the steel band, at least one tube magazine opening of the same size as a tube and a rigid tube buttress on the tube magazine for positioning the first tube in correct position in front of the said recess.

2. A locking sleeve magazine feed attachment according to claim 1, wherein a motor drive means is provided as a working cylinder.

3. A locking sleeve magazine feed attachment for the sheet metal bands of claim 1 wherein a band is bent with its end portions overlapping in such manner that the first strip end portion extends parallel to the unbent area of the opposite band and the other second band end portion lies outside of and rests on the first band end portion and is positioned at an acute angle to the straight tube area, the tubes being stored in the tube magazine in the direction of the conveyance therefrom of the tubes with their overlapping end portions facing forward, the first band end portion being positioned adjacent to a recess in the magazine, the tube buttress having an obtuse-angled strip positioning surface and the first portion of the positioning surface extending parallel in the first swivel position of the tube magazine to the lengthwise cross-section side of the steel band and the second portion of the positioning surface being constructed to receive the second strip end portion positioned at an obtuse angle such that the supplementary or complementary angle corresponds to the angle that includes the second strip end portion and the straight tube section opposite the second strip end portion.

4. A locking sleeve magazine feed attachment according to claim 3 wherein the tube magazine is constructed as a drum magazine in which the tubes are stored with their lengthwise cross-section center axes positioned radially.

5. A locking sleeve magazine feed attachment according to claim 4, wherein the tubes are arranged radially with their second strip end portions in the said drum magazine.

6. A locking sleeve magazine feed attachment according to claim 4 further comprising a tube magazine constructed with a chamber-like housing having a tube buttress fastened thereto and a removable cover which locks onto the housing, the recess in the housing and the steel band openings being positioned in the housing floor and in the cover, a housing tube concentrically positioned in the housing to form with the cover a circular tube guide channel in which a spring-loaded tube valve is fitted.

7. A locking sleeve magazine feed attachment according to claim 6, wherein the housing tube is housed on an axle extending axially in the housing and rotatable in the housing cover, a pre-stressed spiral spring in the housing tube, the inner end portion of which is attached to the housing with its outer, bent end fitting into a radially arranged slit in the housing tube, and projecting into the tube guide channel for carrying the tube valve.

8. A locking sleeve magazine feed attachment according to claim 7, wherein the axle is pipe-shaped and a removable pin is inserted into its aperture for holding the cover to a housing nozzle.

9. A locking sleeve magazine feed attachment according to claim 8, wherein a removable stop connector secures the pin in an axial direction positioned in such manner that at its insertion-end portion the pin has a snap ring groove in which a snap ring is positioned so that it projects radially, outside the housing floor, and is supported in an axial orientation.

* * * * *